US010822210B2

(12) United States Patent
Hoetzendorfer et al.

(10) Patent No.: US 10,822,210 B2
(45) Date of Patent: Nov. 3, 2020

(54) RAIL VEHICLE HAVING CRANE RAILS FOR A GANTRY CRANE

(71) Applicant: Plasser & Theurer Export von Bahnbaumaschinen Gesellschaft m.b.H., Vienna (AT)

(72) Inventors: Patrick Hoetzendorfer, Engerwitzdorf (AT); Manfred Brunninger, Altenberg (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 0 days.

(21) Appl. No.: 16/341,331

(22) PCT Filed: Oct. 6, 2017

(86) PCT No.: PCT/EP2017/001178
§ 371 (c)(1),
(2) Date: Apr. 11, 2019

(87) PCT Pub. No.: WO2018/082797
PCT Pub. Date: May 11, 2018

(65) Prior Publication Data

US 2020/0048053 A1 Feb. 13, 2020

(30) Foreign Application Priority Data

Nov. 4, 2016 (AT) ..... A 506/2016

(51) Int. Cl.
*B66C 23/50* (2006.01)
*B61D 15/02* (2006.01)
(Continued)

(52) U.S. Cl.
CPC ..... *B66C 23/50* (2013.01); *B61D 15/02* (2013.01); *B66C 19/00* (2013.01); *E01B 29/02* (2013.01)

(58) Field of Classification Search
CPC ..... E01B 29/02; E01B 29/05; E01B 29/06; B66C 19/00; B66C 23/50; B61D 15/02
(Continued)

(56) References Cited

U.S. PATENT DOCUMENTS 4,261,264 A 4/1981 Theurer et al.
4,773,332 A * 9/1988 Theurer ..... E01B 29/02 104/3

(Continued)

FOREIGN PATENT DOCUMENTS

CN 1172187 A 2/1998
CN 101031687 A 9/2007

(Continued)

OTHER PUBLICATIONS

International Search Report of PCT/EP2017/001178, dated Jun. 2, 2018.

(Continued)

*Primary Examiner* — Zachary L Kuhfuss
(74) *Attorney, Agent, or Firm* — Collard & Roe, P.C.

(57) ABSTRACT

The invention relates to a rail vehicle (1) having a machine frame (2) supported on on-track undercarriages (4), on both sides of which are arranged—in the longitudinal direction (3) of the rail vehicle—crane rails (8) for a mobile gantry crane (11). In this, for lifting or lowering of the gantry crane (11), a crane rail section (12) of the respective crane rail (8) is arranged to be vertically adjustable by a drive (18). In this manner, contrary to the prior art, a higher gantry crane (11) can be used without violating a given clearance profile during transfer travel.

9 Claims, 2 Drawing Sheets

(51) Int. Cl.
*B66C 19/00* (2006.01)
*E01B 29/02* (2006.01)

(58) Field of Classification Search
USPC ..... 104/4
See application file for complete search history.

(56) References Cited

U.S. PATENT DOCUMENTS

| | | | | | |
|---|---|---|---|---|---|
| 4,979,247 | A * | 12/1990 | Buhler | E01B 29/05 | 104/5 |
| 5,778,794 | A * | 7/1998 | Theurer | E01B 29/05 | 104/2 |
| 2020/0048053 | A1 * | 2/2020 | Hoetzendorfer | B66C 19/00 | |

FOREIGN PATENT DOCUMENTS

| | | | |
|---|---|---|---|
| CN | 201620324 | U | 11/2010 |
| CN | 202730565 | U | 2/2013 |
| CN | 202989702 | U | 6/2013 |
| DE | 2228196 | A1 | 1/1973 |
| DE | 2913639 | A1 | 3/1980 |
| EP | 0108168 | A1 | 5/1984 |
| FR | 2307914 | A1 | 11/1976 |
| WO | 2016008563 | A1 | 1/2016 |

OTHER PUBLICATIONS

Chinese Office Action in Chinese Application No. 201780067748.5, dated Jul. 2, 2020.
English translation of Chinese Office Action in Chinese Application No. 201780067748.5, dated Jul. 2, 2020.

* cited by examiner

RAIL VEHICLE HAVING CRANE RAILS FOR A GANTRY CRANE

CROSS REFERENCE TO RELATED APPLICATIONS

This application is the National Stage of PCT/EP2017/001178 filed on Oct. 6, 2017, which claims priority under 35 U.S.C. § 119 of Austrian Application No. A 506/2016 filed on Nov. 4, 2016, the disclosures of which are incorporated by reference. The international application under PCT article 21(2) was not published in English.

FIELD OF TECHNOLOGY

The invention relates to a rail vehicle having a machine frame supported on on-track undercarriages, on both sides of which are arranged—in the longitudinal direction of the rail vehicle—crane rails for a mobile gantry crane.

PRIOR ART

Various known rail vehicles or track maintenance wagons serve for exchanging track sections by means of a gantry crane in a train formation. In particular, track panels or rail pieces or sleepers are transported along the track renewal train. To that end, the gantry crane is mobile by means of separate undercarriages in a longitudinal direction of the track on crane rails which are arranged at both sides on the particular rail vehicle.

A rail vehicle of this type is known, for example, from DE 2 228 196 A1. Here, several gantry cranes are provided for transporting track panels.

Due to a clearance profile to be observed and the thus limited structural possibilities, gantry cranes usually have a low overall height. This results in reductions of the height available for the materials or containers to be lifted, and of the work comfort.

SUMMARY OF THE INVENTION

The object of the invention is to provide an improvement over the prior art for a rail vehicle of the type mentioned at the beginning.

According to the invention, this object is achieved by way of a rail vehicle according to claim 1. Dependent claims relate to advantageous embodiments of the invention.

The invention provides that, for lowering or lifting of the gantry crane, a crane rail section of the respective crane rail is arranged to be vertically adjustable by a drive. The essential advantage here lies in the fact that the gantry crane is designed with greater height and, as a result of the lowering of the crane rail section, does not penetrate the profile of the clearance gauge space during transfer travel.

An advantageous further development provides that that the machine frame is upwardly recessed in order to form a work space thereunder. Thus, a safe work area for the worker is created. This improvement is possible because a higher gantry crane than in the prior art can be used.

A useful further development is realized in that the respective crane rail has two vertically adjustable crane rail sections for accommodating a respective crane undercarriage. In this, it is advantageous that each crane undercarriage is lowered individually, and that the crane rail does not need to be lowered over the entire length of the gantry crane.

A particularly advantageous embodiment provides that that the respective drive is configured to be hydraulic. This ensures a compact structural design as well as a uniform motion of the crane rail sections, and a high positioning precision.

A further advantage of the invention exists if one crane undercarriage in each case is lockable by means of a locking device on the vertically adjustable crane rail section. With this, a relative motion of the gantry crane with respect to the rail vehicle during transfer travel is counteracted.

In a further advantageous embodiment of the invention, the particular vertically adjustable crane rail section is designed for locking the gantry crane in a lowered position. By this, the crane undercarriages are additionally confined in their movement in the longitudinal direction of the track during transfer travel, which represents a further safety device.

In this, it is advantageous if the respective crane undercarriage is confined in a lowered position by buffers. As a result, the crane undercarriages and the ends of the crane rail are protected from wear.

An additional improvement of the invention provides that a crane rail support, a vertical guide and a centering device are arranged for coupling the respective vertically adjustable crane rail section to the machine frame. Thus, a low-friction lowering- or lifting motion without jamming is ensured.

In a further embodiment of the invention, it is provided that the respective vertically adjustable crane rail section has a securing device for locking in the raised position. Thus, a safe running across the crane rail sections during working operation of the gantry crane is ensured.

Additional advantages of the invention become apparent from the drawing description.

BRIEF DESCRIPTION OF THE DRAWINGS

The invention will be described by way of example below with reference to the attached figures. There is shown in.

DESCRIPTION OF THE EMBODIMENTS

Figure 1:
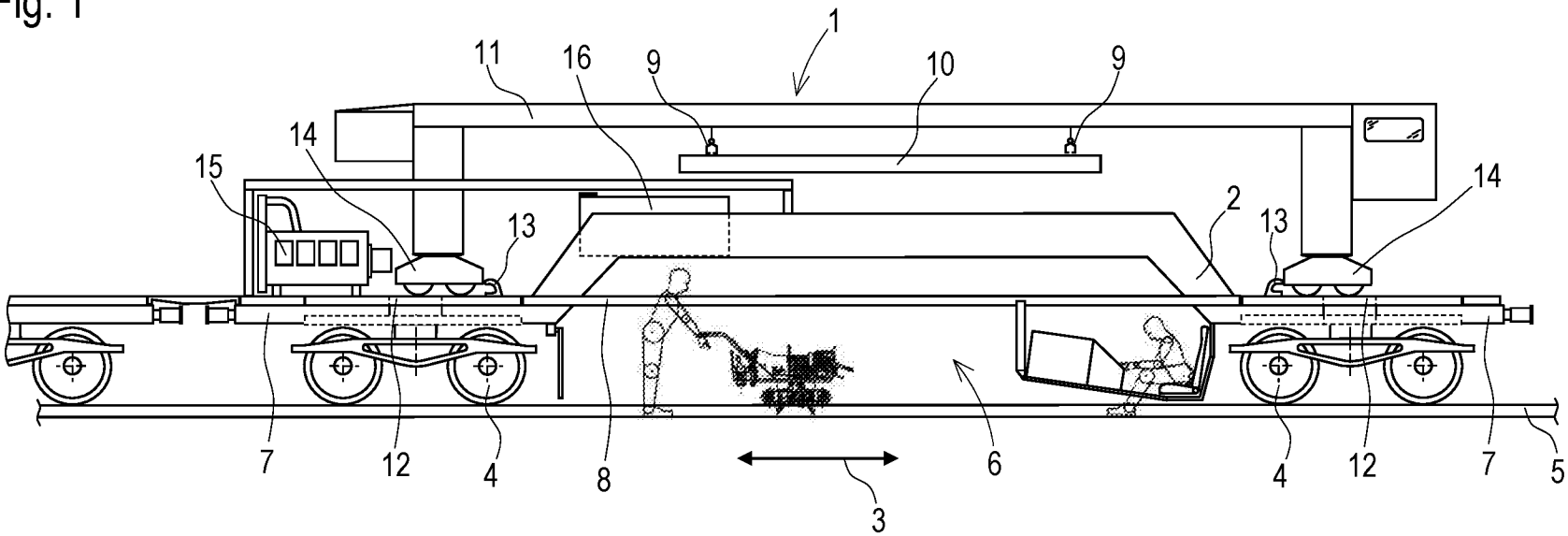
FIG. 1 a schematic side view of a rail vehicle.

A rail vehicle 1 visible in FIG. 1 has an upwardly recessed machine frame 2 which extends in a longitudinal direction 3 of the vehicle and is supported on on-track undercarriages 4 or mobile by means of the latter on a track 5. Located underneath the machine frame 2 and between the on-track undercarriages 4 is a work space 6. The rail vehicle 1 comprises a separate motive drive 15 and a hydraulic system 16.

The machine frame 2 has, at its longitudinal beams 7 at both sides with regard to the longitudinal direction 3 of the rail vehicle, crane rails 8 for mobility of a gantry crane 11 equipped with griping devices 9 for seizing track panels 10. Situated above the on-track undercarriages 4 are vertically adjustable crane rail sections 12 including locking devices 13 for locking the crane undercarriages 14. The respective locking device 13 comprises, for example, an upwardly pivotable hook which fixates the gantry crane 11 during the lowering or lifting as well as during transfer travel.

Figure 2:
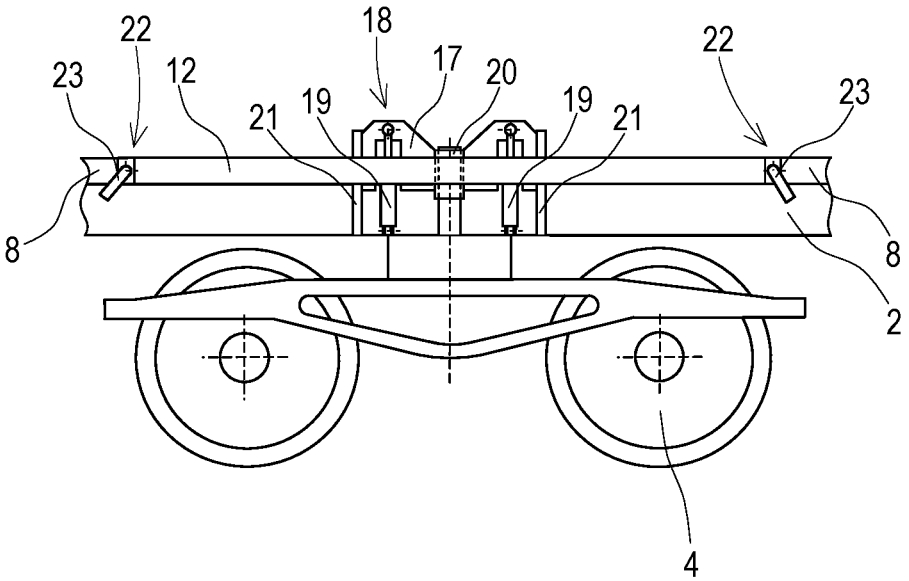
FIG. 2 a detail view of crane rail section in raised position.

FIG. 2 shows a detail view of the raised crane rail section 12 with on-track undercarriage 4 and machine frame 2. Arranged laterally at the machine frame 2 is a crane rail support 17. Located on the same is a drive 18 consisting of two vertically acting hydraulic cylinders 19, a centering device 20 and a vertical guide 21. The two hydraulic cylinders 19 are in the extended position. At either end, the crane rail section 12 has a safety device 22 including a safety bolt 23.

Figure 3:
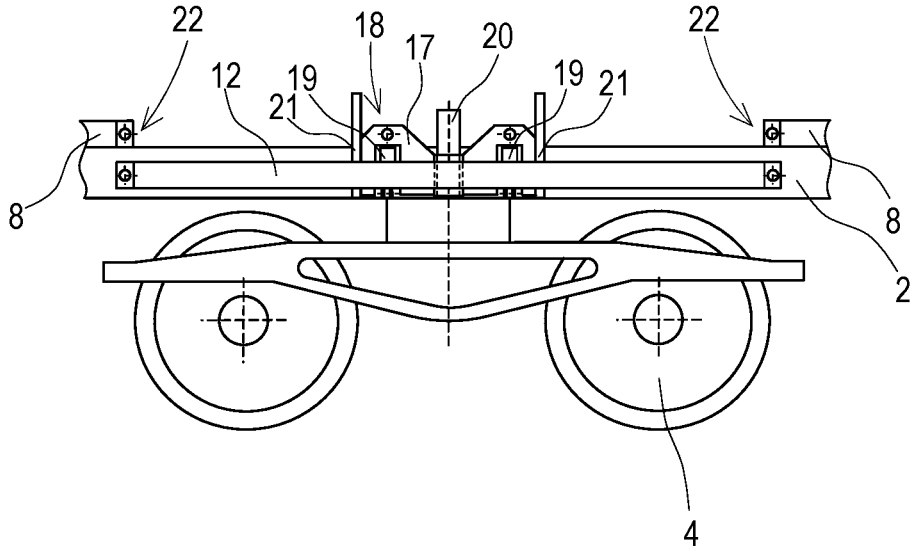
FIG. 3 a detail view of crane rail section in lowered position.

FIG. 3 shows a detail view of the crane rail section 12 in lowered position with on-track undercarriage 4 and machine frame 2. The two hydraulic cylinders 19 are in the retracted position, the crane rail section 12 is thus in the lowered position.

Figure 4:
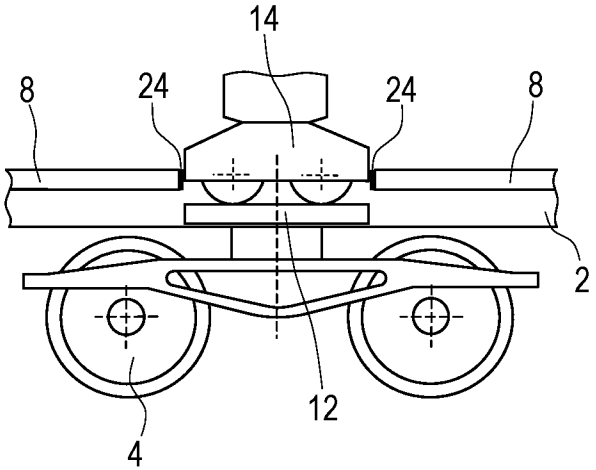
FIG. 4 a detail view of a lowered crane undercarriage and confinement by buffers.

FIG. 4 shows an alternative example of embodiment of the lowerable crane rail section 12. Here, the length of the crane rail section 12 is matched exactly to the length of the crane undercarriage 14. An additional locking device 13 can thus be omitted here, since the crane undercarriage 14 in the lowered position is confined in its movement in the longitudinal direction 3 of the rail vehicle. The not-lowered ends of the crane rails 8 and/or the crane undercarriages 14 have buffers 24.

The invention claimed is:

1. A rail vehicle comprising:

a machine frame a plurality of on-track undercarriages, wherein said machine frame is supported on said plurality of on-track undercarriages, a plurality of crane rails;

a mobile gantry crane coupled to said plurality of crane rails, wherein said plurality of crane rails comprise crane rails on both sides of the rail vehicle, wherein said crane rails are arranged in the longitudinal direction of the rail vehicle, a drive for lowering or lifting of the gantry crane, on a crane rail section of the respective plurality of crane rails wherein said drive is configured to make the crane rail section to be vertically adjustable by said drive.

2. The rail vehicle according to claim 1, wherein the machine frame is upwardly recessed in order to form a work space thereunder.

3. The rail vehicle according to claim 1, wherein the respective crane rail has two vertically adjustable crane rail sections for accommodating a respective crane undercarriage.

4. The rail vehicle according to claim 1, wherein the respective drive is configured to be hydraulic.

5. The rail vehicle according to claim 1, further comprising a locking device, wherein one crane undercarriage in each case is lockable by means of said locking device on the vertically adjustable crane rail section.

6. The rail vehicle according to claim 1, wherein the particular vertically adjustable crane rail section is designed for locking the gantry crane in a lowered position.

7. The rail vehicle according to claim 1, further comprising buffers, wherein the respective crane undercarriage is confined in a lowered position by buffers.

8. The rail vehicle according to claim 1, wherein a crane rail support, a vertical guide and a centring device are arranged for coupling the respective vertically adjustable crane rail section to the machine frame.

9. The rail vehicle according to claim 1, wherein the respective vertically adjustable crane rail section has a securing device for locking in the raised position.

* * * * *